US011241036B1

(12) United States Patent
Fraser

(10) Patent No.: US 11,241,036 B1
(45) Date of Patent: Feb. 8, 2022

(54) SMOKING PIPE APPARATUS

(71) Applicant: Alexander Droldium Fraser, Petaluma, CA (US)

(72) Inventor: Alexander Droldium Fraser, Petaluma, CA (US)

( * ) Notice: Subject to any disclaimer, the term of this patent is extended or adjusted under 35 U.S.C. 154(b) by 245 days.

(21) Appl. No.: 16/378,465

(22) Filed: Apr. 8, 2019

Related U.S. Application Data

(60) Provisional application No. 62/654,261, filed on Apr. 6, 2018.

(51) Int. Cl.
*A24F 5/10* (2006.01)
*A63H 33/18* (2006.01)
*A24F 3/00* (2006.01)

(52) U.S. Cl.
CPC ..... *A24F 5/10* (2013.01); *A24F 3/00* (2013.01); *A63H 33/18* (2013.01)

(58) Field of Classification Search
None
See application file for complete search history.

(56) References Cited

U.S. PATENT DOCUMENTS 4,320,593 A * 3/1982 Sarkis ..... A24F 3/00 446/47

OTHER PUBLICATIONS

Puff-n-Pass, http://www.puff-n-pass.com/, screen captures dated Jan. 16, 2018 obtained from Wayback Machine https://archive.org/web/ (Year: 2018).*

* cited by examiner

*Primary Examiner* — Michael J Felton
*Assistant Examiner* — Katherine A Will
(74) *Attorney, Agent, or Firm* — Gary Hoenig

(57) ABSTRACT

A flying disc smoking pipe apparatus is provided wherein a flying disc, having a central opening, has a centrally mounted smoking pipe insert within the central opening, having a plurality of draw pipes extending radially from the insert to and through the flying disc shaped housing lip. The distal end of the draw pipes is flush with the outside circumference of the flying disc. A smoking bowl is provided in the top of the insert and is in direct pneumatic communications with the draw pipes. The flying disc housing facilitates passing the pipe amongst multiple users at a distance by gliding the pipe from user to user. A single user may draw smoke through a draw pipe and selectively adjust the smoke temperature by throttling air flow into other draw pipes. Multiple users may also smoke simultaneously. The flying disc smoking pipe apparatus further provides entertainment and recreation to smoking.

6 Claims, 5 Drawing Sheets

SMOKING PIPE APPARATUS

This non-provisional utility patent application, filed in the United States Patent and Trademark Office, claims the benefit of U.S. Provisional Patent Application Ser. No. 62/654,261 filed Apr. 6, 2018 which is hereby incorporated by reference.

FIELD OF THE INVENTION

The invention relates to smoking devices and more particularly to a flying disc smoking pipe apparatus for sharing and passing amongst a plurality of smokers.

BACKGROUND OF THE INVENTION

Pipe smoking of leafy substances for recreation, amusement and relaxation has long been a tradition. Consequently smoking pipe designs have emphasized many differing goals including artistic appearance or novelty and practical goals wherein designs including multi-user mechanisms, smoke cooling systems, smoke filtering, and flavor imparting techniques. Therefore there is always a need for an improved smoking pipe incorporating a combination of features emphasizing a number of smoking pipe design goals. In particular there is a need for a multi-user smoking pipe that can be shared between users located at a distance from each other.

SUMMARY OF THE INVENTION

Accordingly, the present invention is directed to a smoking pipe comprises a gliding or flying recreational flying disc shaped housing having a concave bottom surface providing aerodynamic lift and a smoking bowl concentrically disposed and formed in an upper assembly portion being a circular wooden plate concentrically mounted to the top of the flying disc housing having a centrally disposed circular opening, and a lower assembly portion, also being a circular wooden plate concentrically fixed to the bottom of the flying disc housing having a port in direct pneumatic communication with the smoking bowl and having a plurality of draw pipe bores radially arranged to receive draw pipes each draw pipe providing direct pneumatic communication between the smoking bowl, the port, and through the circumferential lip of the flying disc housing. The wooden smoking bowl is formed from wood species selected to impart flavors and aromas to the substances being smoked. A smoking bowl insert, being constructed from wood or metal, is optionally inserted within the smoking bowl. A further optional smoking bowl lid is provided to securely retain lit material within the smoking bowl.

Material to be smoked is inserted into the wooden smoking bowl or metal smoking bowl insert and lit with utilizing a method similar to the method to light material in a convention smoking pipe. The user presses their lips to a draw pipe opening with the ends being flush mounted in the outer circumference lip of the flying disc housing and draws air through the material in the smoking bowl whilst lighting the material. Obstructing other draw pipe openings forces air to be drawn through the smoking bowl to assist the lighting process.

An objective of the present invention is to facilitate passing a smoking pipe between users at a distance by gliding the flying disc from user to user whilst avoiding the extinguishment of the lit substance.

Another objective of the present invention is to facilitate user selective control of the temperature of the smoke drawn through a draw pipe. The user may then draw smoke from the smoking bowl by pressing the user lips against the draw pipe hole in the outer circumference lip of the flying disc housing; however, air will also be drawn in through other draw pipes thereby diluting and cooling the smoke drawn through the smoking bowl. The user may, however, selectively obstruct other draw pipes to control the air flow.

A yet further objective of the present invention is to provide a means for multiple users to smoke simultaneously. Each draw pipe opening in the outer circumference provides a means for a user to draw smoke, consequently multiple users may simultaneously draw smoke.

Another advantage of the flying disc shape of the smoking pipe includes facilitating amusement and recreational use of the apparatus. This and other advantages of the present invention overcome many of the disadvantages of the prior art.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

In the drawings.

DETAILED DESCRIPTION OF THE INVENTION

Although particular embodiments of the invention have been described in detail for purposes of illustration, various modifications may be made without departing from the spirit and scope of the invention. As used herein, the term flying disc refers to the well known recreation and sport gliding disc having a lower cavity and a lip extending downward around the outer circumference thereby providing aerodynamic lift when rotated around the central axis and propelled away from the user. Where examples are presented to illustrate aspects of the invention, these should not be taken as limiting the invention in any respect.

Figure 1:
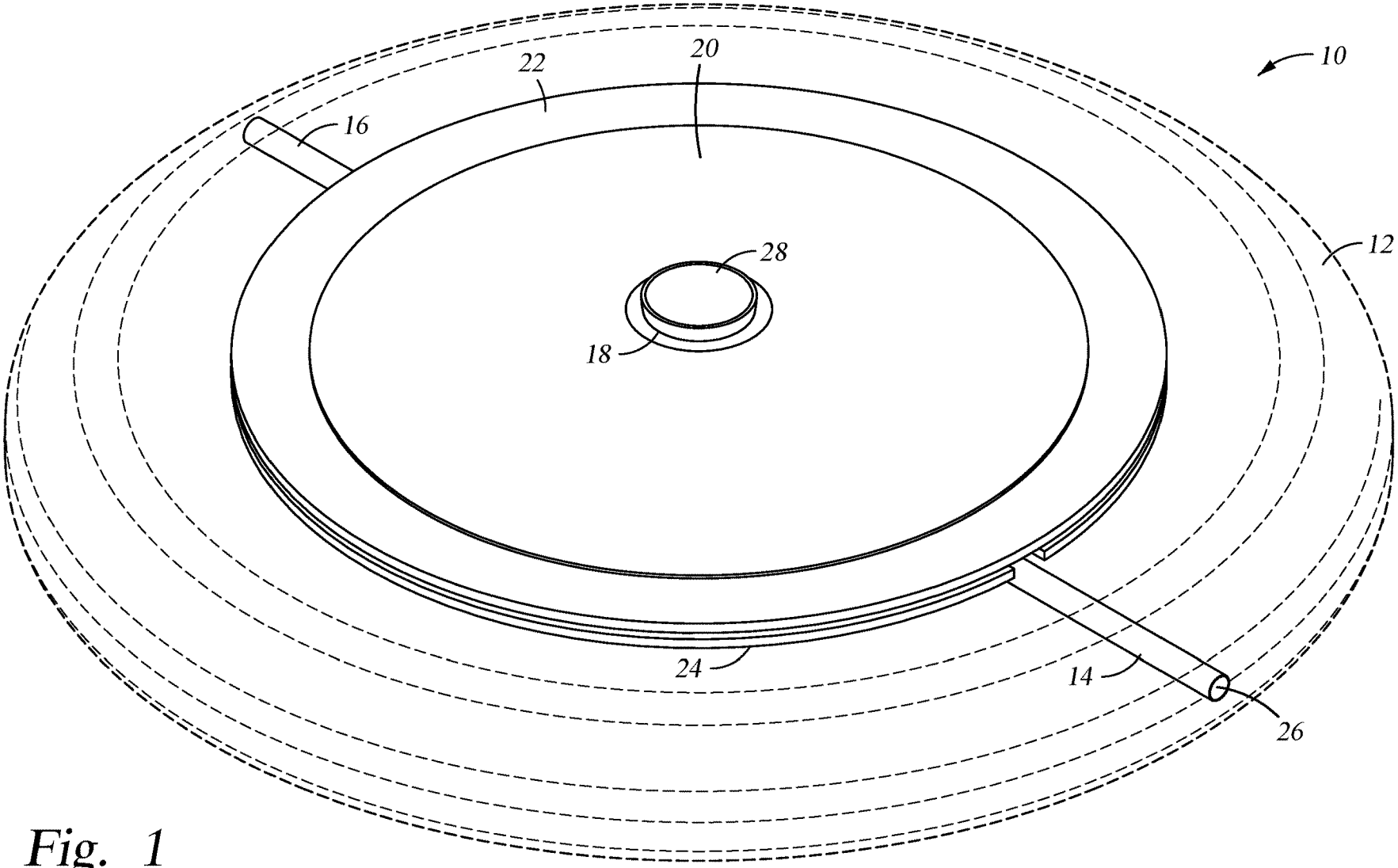
FIG. 1 is a perspective view of the smoking pipe according to the present invention.
Figure 2:
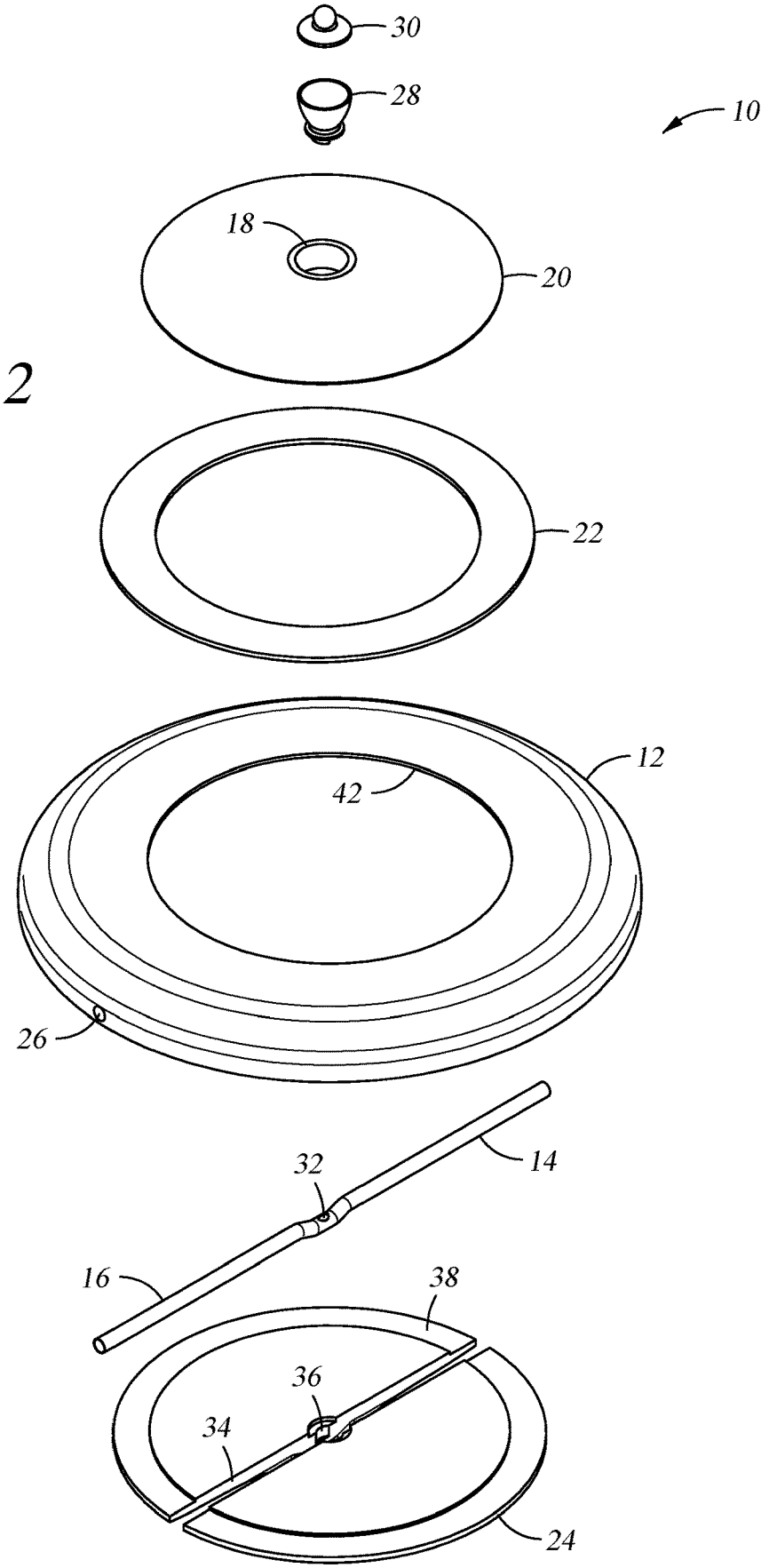
FIG. 2 is an exploded view of the smoking pipe of FIG. 1 wherein the spatial relationship of the constituent elements is shown.

Now referring in greater detail to the various figures of the drawings wherein like reference characters refer to like parts, there is shown in FIG. 1 a flying disc smoking pipe apparatus 10. Referring to FIGS. 1 and 2, a flying disc housing 12 has a concentrically and centrally formed opening 42. The central opening 42 receives an upper assembly portion 20 being a circular wooden plate concentrically and centrally fixed to the top of the flying disc housing. The upper assembly portion must have an outside circumference greater than the circumference of the flying disc housing 12 central opening 42 and less than the outer circumference of the flying disc housing 12. The upper assembly portion 20 further comprises a smoking bowl 18 concentrically and centrally formed in the upper assembly portion 10. The wood species is selected to impart a selected flavor and aroma to the smoke. An optional smoking bowl insert 28 may be disposed within the smoking bowl 18. A balance ring 22 is also optionally provided to strengthen the assembly and to distribute weight towards the outer circumference of the flying disc housing thereby improving the stability of the apparatus whilst in flight.

Referring next to FIG. 2, an exploded view of the present invention, elements of the lower assembly portion 24 are illustrated. The lower assembly portion 24 is preferentially constructed of wood as is the upper assembly portion 20 and similarly circular in shape and having a similar outer circumference. The top of the lower assembly portion 24 is recessed at 38 to receive the bottom of the flying disc housing 12 thereby providing direct contact between the top of the lower assembly portion 24 and the bottom of the upper assembly portion 20 permitting the upper and lower assemblies to be adhesively fixed to each other and to the flying disc housing 12. The lower assembly portion 24 further includes port 36 bored into the top of the lower assembly portion 24. Port 36 provides direct pneumatic communication between the smoking bowl 18 or smoking bowl insert 28 and the draw pipes 14 and 16. An embodiment having a combined of draw pipes 14 and 16 is illustrated wherein a draw pipe port 32 is shown wherein draw pipe port 32 is in direct pneumatic communications with the port 36; however noncontiguous draw pipes 14 and 16 are an alternate embodiment. Noncontiguous draw pipes are necessary if more than two draw pipes are utilized. The proximate ends of the draw pipes are disposed within draw pipe bores 34 in the lower assembly portion 24 and extend radially along the bottom of the flying disc housing 12 and through a respective lip bore 26 in the flying disc housing outer circumference. The distal ends of draw pipes 16 and 14 are fixed flush to the outer circumference lip.

Figure 3:
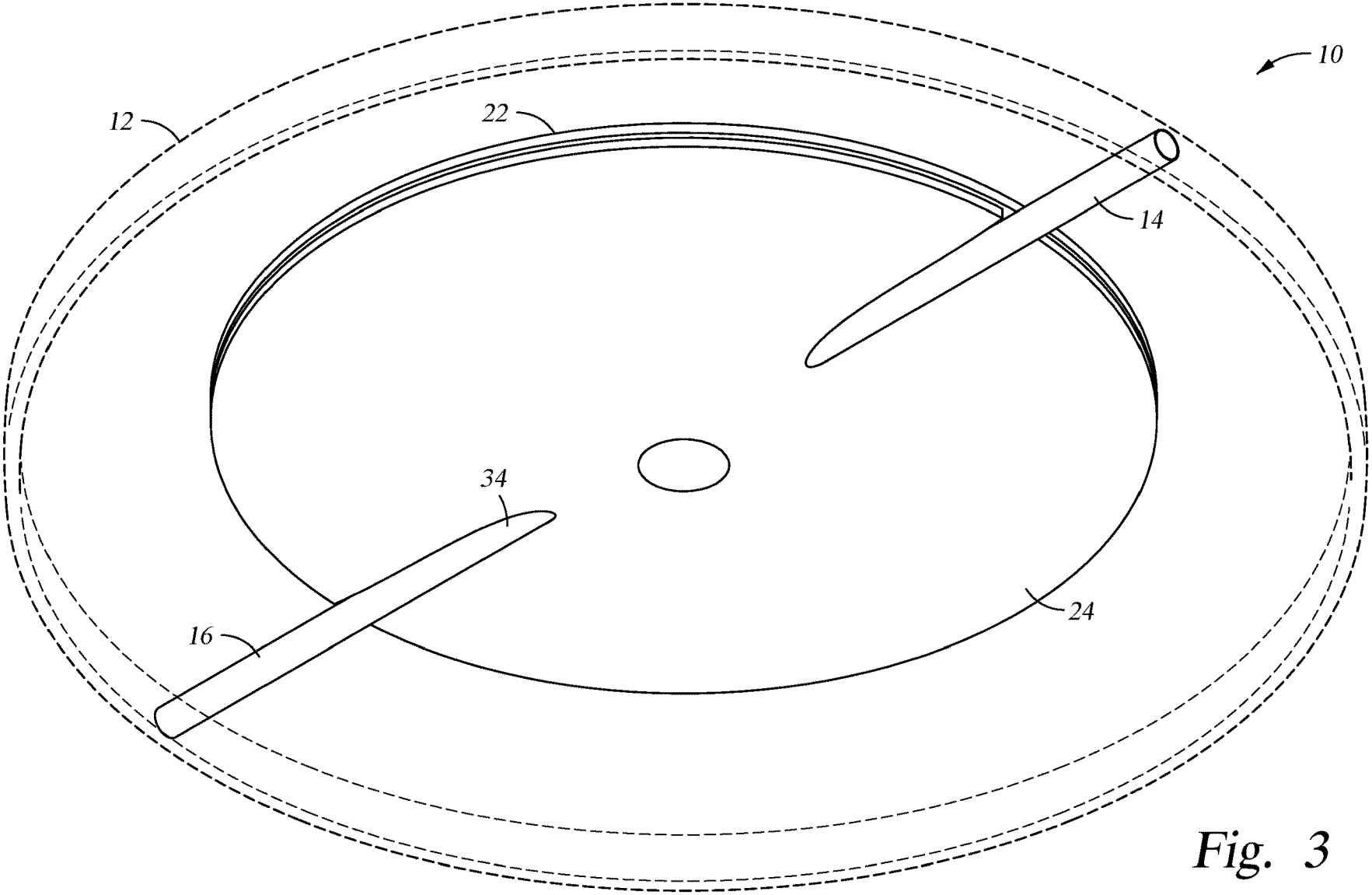
FIG. 3 is a perspective view of the bottom of the lower central plate element of FIG. 2 showing an embodiment with two draw pipes.

In FIG. 3, a bottom perspective view of the lower assembly portion 24 illustrates the positioning of the draw pipes 14 and 16 disposed within the draw pipe bore 34. Note that the bottom surface of the lower assembly portion 24 is contoured and thickens towards the central port. The contour provides aerodynamic stability whilst also minimizing weight. The balance ring 22 is optionally utilized to move the center of gravity away from the thicker and heavier smoking bowl region. Although the lower assembly portion 24 is preferentially constructed of wood, the wood species need not match the wood of the upper assembly portion as the lower assembly portion 24 wood does not influence the flavor or aroma of the smoke.

Figure 4:
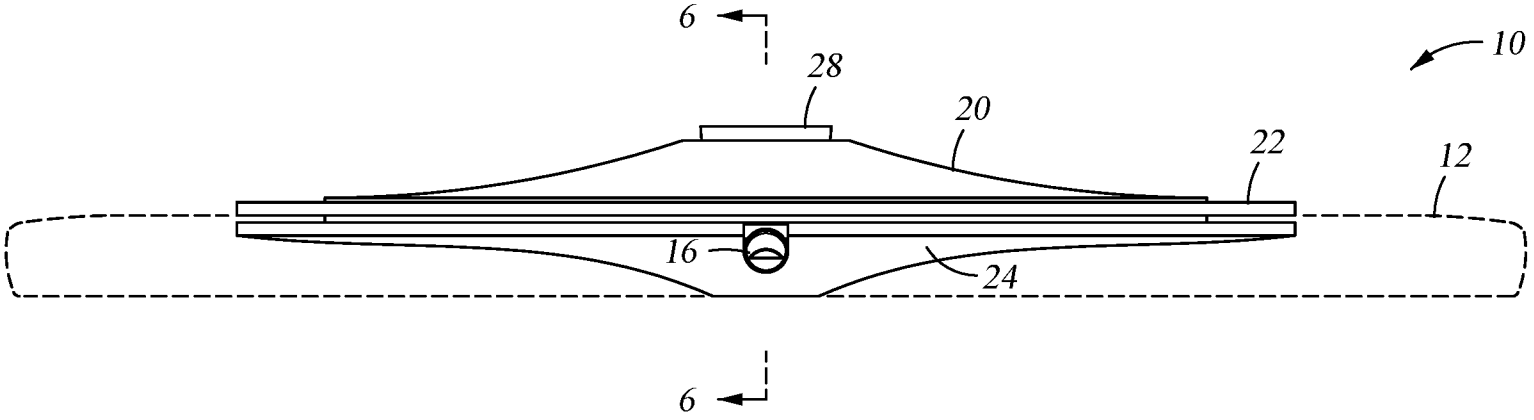
FIG. 4 is a front side elevation view of the smoking pipe upper and lower assembly portions showing the upper and lower central plates, the smoking bowl and the distal end of a draw pipe.
Figure 5:
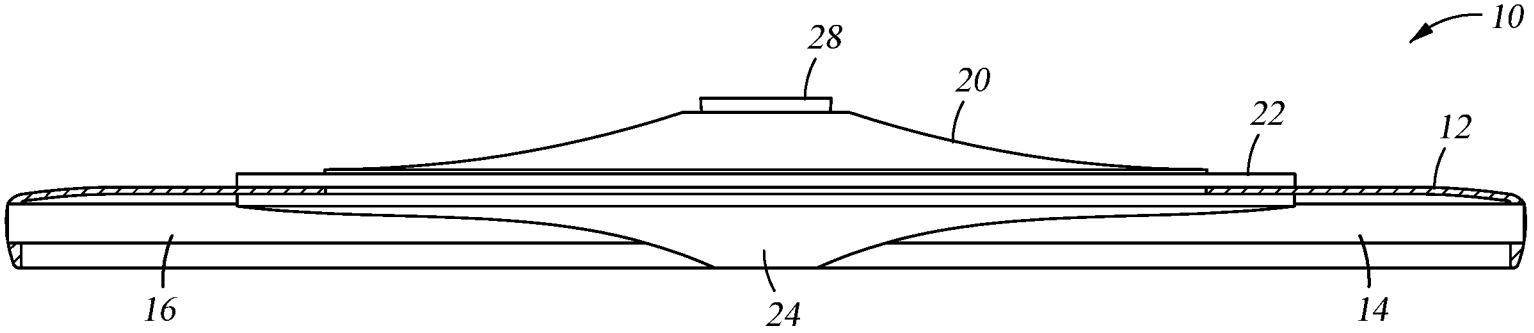
FIG. 5 is a right side elevation view of the smoking pipe upper and lower assembly portions showing the upper and lower central plates, the smoking bowl, and the side views of the draw pipes.

Referring now to FIGS. 4 and 5, side elevation views of the present invention, The contours of the top of the upper and lower assembly portions 20 and 24 are illustrated as well as the aerodynamic profiling of the contours. The upper and lower assembly portions 20 and 24 are adhesively fixed to each other and to the top and bottom of the flying disc housing 12 between the two assembly portions. The disposition of draw pipes 14 and 16 are also illustrated to adjacent to the bottom surface of the flying disc housing 12. It will be appreciated that the draw pipes should be disposed close to the bottom surface of the flying disc housing to minimize disruption of the aerodynamics within the flying disc housing cavity. It will also be appreciated that embodiments comprising more than two draw pipes the draw pipes angles between the draw pipe radial positions must be the same else the apparatus will be unbalanced and flight stability and performance of the apparatus will be degraded.

Figure 6:
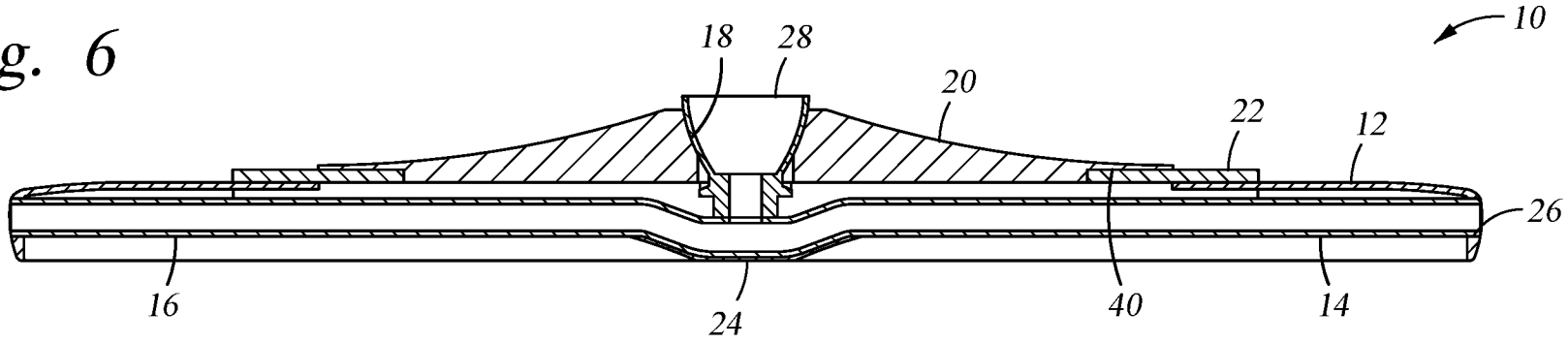
FIG. 6 is a cross section view of the smoking pipe upper and lower assembly portions taken from Line 6-6 of FIG. 5 showing details of the smoking bowl connectivity with the draw pipes.
Figure 7:
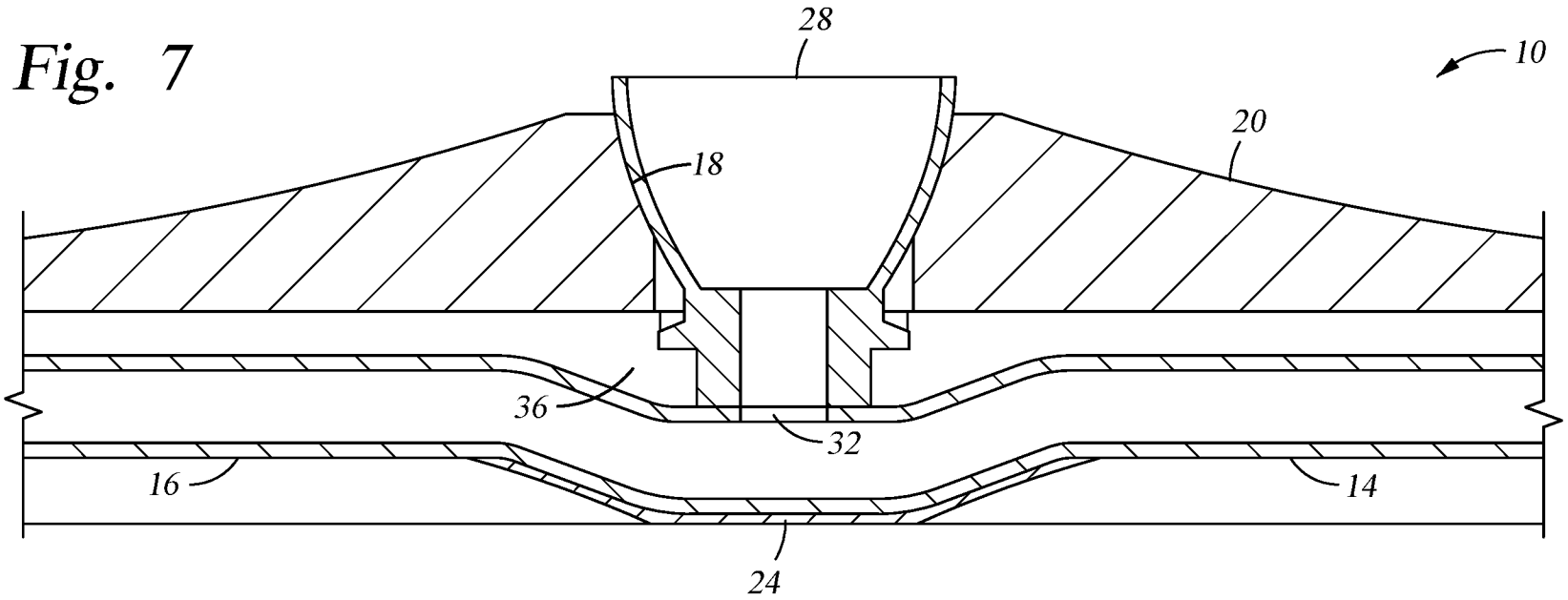
FIG. 7 is an expanded view of FIG. 6 showing further details of the smoking bowl and draw pipes of the smoking pipe upper and lower assembly portions.

Further details of the upper and lower assembly portions 20 and 24 are illustrated in FIGS. 6 and 7. FIG. 6, being a cross section view taken along Line 6-6 of FIG. 4, shows the smoking bowl insert 28 fitted within the wooden smoking bowl 18 of the upper assembly portion 20. The smoking bowl insert may be constructed of metal or wood. The smoking bowl insert 28 bottom extends into the port 36 and is in direct pneumatic communication with the draw pipes 14 and 16 through draw pipe port 32. Details of the balance ring 22 are also shown wherein the optional balance ring 22 is retained within the balance ring recess 40 formed in the upper assembly portion 20. The flying disc housing 12 is disposed between the upper and lower assembly portions 20 and 24 with the distal ends of the draw pipes 14 and 16 extending out to and through the flying disc housing outer circumference lip at respective lip bores 26.

I claim:

1. A flying disc smoking pipe apparatus comprising;

a flying disc housing having a central concentrically positioned circular opening, an outer circumference, a cavity, an outer circumference lip, a top and a bottom, an upper assembly portion concentrically fixed to the top of the flying disc housing and having a circular shape with an outside diameter greater than the diameter of the flying disc housing central circular opening and less than the outside diameter of the flying disc housing, and a central bore concentrically positioned being a smoking bowl receiving substances to be smoked, a lower assembly portion concentrically fixed to the bottom of the flying disc housing and having a circular shape with an outside diameter being the same as the upper assembly portion, and a central circular port in the top of the lower assembly portion arranged to align with the bottom of the upper assembly portion smoking bowl providing direct pneumatic communication between the smoking bowl and the central circular port, at least two draw pipes each having a proximate and a distal end, disposed radially within the flying disc housing cavity, the proximate end retained by a draw pipe bore in the lower assembly portion, the draw pipe bore extending radially from the lower assembly portion port to the outside diameter of the lower assembly portion, and the distal draw pipe end received by a bore through the flying disc housing outer circumference lip, the draw pipes being in direct pneumatic communication between the lower assembly portion port and the distal ends of the draw pipes, whereby a user may smoke lit material in the smoking bowl by drawing on the distal end of a draw pipe.

2. The flying disc smoking pipe apparatus of claim 1 further comprising a metal smoking bowl insert received by the smoking bowl in the upper assembly portion.

3. The flying disc smoking pipe apparatus of claim 1 wherein the upper assembly portion is constructed of wood.

4. The flying disc smoking pipe apparatus of claim 1 wherein the smoking bowl is constructed of wood, the wood being a wood species suitable for imparting flavor to a substance being smoked.

5. The flying disc smoking pipe apparatus of claim 1 further comprising a removable smoking bowl lid.

6. The flying disc smoking pipe apparatus of claim 2 further comprising a removable smoking bowl insert lid.

* * * * *